US005881411A

United States Patent [19]

Threlkeld

[11] Patent Number: 5,881,411

[45] Date of Patent: Mar. 16, 1999

[54] TWISTED, DYED AND BONDED FILAMENTS

[75] Inventor: James O. Threlkeld, Charlotte, N.C.

[73] Assignee: FyPro Thread Company, Inc., Charlotte, N.C.

[21] Appl. No.: 772,693

[22] Filed: Dec. 23, 1996

[51] Int. Cl.[6] ..... D06B 1/08

[52] U.S. Cl. ..... 8/151; 8/155; 68/200

[58] Field of Search ..... 68/205 R, 200, 68/202, 206, 203, 205 E; 8/151, 155, 151.1, 149.1, 154, 156, 151.2; 57/32, 289, 290, 295, 296, 292, 350, 362, 58.83, 11, 12, 60, 64, 66; 28/210, 203 R, 220

[56] References Cited

U.S. PATENT DOCUMENTS

| | | | |
|---|---|---|---|
| 151,694 | 6/1874 | Garsed et al. . | |
| 1,165,495 | 12/1915 | Cooper | 57/12 |
| 1,568,959 | 1/1926 | Chase et al. . | |
| 1,823,258 | 9/1931 | Cramer et al. . | |
| 1,907,898 | 5/1933 | Taylor . | |
| 1,955,719 | 4/1934 | Malkomes | 8/155 |
| 2,061,021 | 11/1936 | Chittenden et al. | 57/12 |
| 2,246,735 | 6/1941 | Kline et al. | 8/151.1 |
| 2,302,620 | 11/1942 | Lovett | 8/151.1 |
| 2,303,274 | 11/1942 | Herrstrom et al. | 8/151.1 |
| 2,367,730 | 1/1945 | Masland, II . | |
| 2,750,250 | 6/1956 | Lindenstruth . | |
| 2,769,727 | 11/1956 | Bowen et al. . | |
| 2,804,764 | 9/1957 | Runton . | |
| 2,875,727 | 3/1959 | Robinson | 68/200 |
| 2,885,878 | 5/1959 | Kocay et al. | 8/151.1 |
| 3,088,792 | 5/1963 | Mathis, Jr. | 8/151.1 |
| 3,164,650 | 1/1965 | Kocay et al. . | |
| 3,167,902 | 2/1965 | Smith et al. | 57/60 |

(List continued on next page.)

FOREIGN PATENT DOCUMENTS

| | | |
|---|---|---|
| 3325958 | 2/1985 | Germany . |
| 861035 | 2/1961 | United Kingdom . |
| 1 253 657 | 11/1971 | United Kingdom . |
| 2 037 188 | 7/1980 | United Kingdom . |

OTHER PUBLICATIONS

Textile Chemical Processing, "Continuous Dyeing—Problems and Solutions," Mar. 1977, pp. 49–51.

*Primary Examiner*—Amy Vanatta
*Attorney, Agent, or Firm*—Kennedy Covington Lobdell & Hickman

[57] ABSTRACT

A method and apparatus for continuously treating traveling filaments includes an assembly for causing at least one filament to travel along a travel path and assembly for rotatably supporting one or more filaments for payout therefrom responsive to the influence of the assembly for causing the filaments to travel, an assembly for rotating the filament supports at a predetermined angular velocity to form a traveling twisted filament and an arrangement for applying treating fluid to the traveling filaments.

25 Claims, 3 Drawing Sheets

U.S. PATENT DOCUMENTS

| | | | |
|---|---|---|---|
| 3,180,004 | 4/1965 | Fisher et al. . | |
| 3,287,888 | 11/1966 | Chidgey . | |
| 3,414,957 | 12/1968 | Langstaff et al. . | |
| 3,533,145 | 10/1970 | Fliessner . | |
| 3,579,766 | 5/1971 | Feinberg . | |
| 3,585,821 | 6/1971 | Beltramini . | |
| 3,751,778 | 8/1973 | Grosjean et al. | 28/72.14 |
| 3,783,596 | 1/1974 | Waldkirich | 57/289 |
| 3,800,565 | 4/1974 | Worth et al. . | |
| 3,808,618 | 5/1974 | Arimoto et al. | 68/200 |
| 3,847,544 | 11/1974 | Quynn . | |
| 3,883,302 | 5/1975 | Amend . | |
| 3,893,806 | 7/1975 | Finch et al. | 8/174 |
| 3,908,247 | 9/1975 | Murphy . | |
| 3,908,408 | 9/1975 | Getchell et al. . | |
| 3,919,749 | 11/1975 | McWhirter et al. . | |
| 3,921,377 | 11/1975 | Snyder | 8/151 |
| 3,973,908 | 8/1976 | Dunn, Jr. | 8/176 |
| 4,031,596 | 6/1977 | Joy . | |
| 4,178,705 | 12/1979 | Birke et al. . | |
| 4,299,015 | 11/1981 | Marcus et al. . | |
| 4,329,750 | 5/1982 | Binnersley . | |
| 4,452,605 | 6/1984 | Love | 8/155 |
| 4,452,607 | 6/1984 | Wessely . | |
| 4,468,921 | 9/1984 | Shibata et al. | 57/333 |
| 4,484,433 | 11/1984 | Stahlecker et al. . | |
| 4,484,435 | 11/1984 | Fritjof . | |
| 4,497,099 | 2/1985 | Scott . | |
| 4,509,320 | 4/1985 | Maeda | 57/12 |
| 4,525,992 | 7/1985 | Payen | 57/12 |
| 4,574,578 | 3/1986 | Scott . | |
| 4,685,284 | 8/1987 | Phillipp et al. | 8/155 |
| 5,070,585 | 12/1991 | Enderlin . | |
| 5,385,584 | 1/1995 | Teramura et al. . | |
| 5,638,669 | 6/1997 | Kallmann | 57/75 |

TWISTED, DYED AND BONDED FILAMENTS

BACKGROUND OF THE INVENTION

The present invention relates broadly to methods and apparatus for preparing and treating traveling filaments and, more particularly, to a method for continuously processing and preparing twisted, dyed and bonded filaments.

Generally, filaments for use in the textile industry for sewing and other applications are prepared for use by application of one of several treatment agents. For example, fibrous filaments may be treated with a bonding agent to reduce fibrous projections from the surface thereof to reduce breakage. These or other filaments may be dyed to produce a desired color. Often filaments will also be treated with a lubricant to enhance their performance ability during industrial sewing operations. Often, these processes are done separately with liquid applications occurring in a bath and, if heat need be applied, it is applied in a hot air oven. The result is a generally slow process for taking raw filament and preparing a fully functioning thread, yarn or other finished filament.

Other treatments may be performed on the filaments which does not involve application of treating agents but rather involves surface texturizing. This includes adding a twist to the fibers to provide bulk or other desired surface textures. Often, the twist will be performed in a jet entanglement unit which entangles multifilament bundles by the application of high-pressure air thereto. This additional process adds to the expense and time required to prepare filaments for use in industry.

There accordingly exists a need for a high-speed process to produce filaments having the desired texturizing and application of treating liquid to rapidly produce a finished filament product.

SUMMARY OF THE INVENTION

It is accordingly an object of the present invention to provide a continuous, in-line process which produces twisted, dyed and bonded filaments.

To that end, a method and apparatus is provided. An apparatus for continuously treating traveling filaments includes an arrangement for causing at least one filament to travel along a travel path, an arrangement for rotatably supporting a first filament for payout thereof responsive to the means for causing the plurality of filaments to travel along the travel path; an assembly for rotating the means for rotatably supporting the first filament at a predetermined angular velocity to form a traveling twisted filament during filament payout therefrom and an arrangement for applying treating fluid to the traveling twisted filament with the treating fluid application arrangement being disposed along the predefined travel path. It is preferred that the apparatus further include an arrangement for thermally treating the traveling twisted filament with the thermal treatment arrangement being disposed along the travel path. Preferably, the arrangement for thermally treating the traveling twisted filament includes at least one pair of rolls with at least one of the rolls being driven and an assembly for heating at least one of the rolls to a predetermined temperature for heating a traveling twisted filament trained thereabout.

It is further preferred that the arrangement for applying a treating fluid to the traveling twisted filament includes an applicator for metering a predetermined amount of treatment fluid onto the traveling twisted filament.

Preferably, the arrangement for applying a treating fluid to the traveling twisted filament includes a supply of treatment fluid including a bonding agent and a release agent. It is further preferred that the arrangement for applying treating fluid to the traveling twisted filament includes a supply of treatment fluid including a dye and, preferably, a lubricant.

The assembly for causing at least one filament to travel along the travel path includes an assembly for winding the traveling twisted filament on a bobbin.

Preferentially, the present invention further includes an assembly for supporting a second filament rotatable about an axis of rotation for payout of the second filament responsive to the assembly for causing at least one filament to travel resulting in a twisted filament bundle suitable for further filament processing. The present invention further preferably includes an arrangement for supporting a third filament rotatable about a second axis of rotation for payout of the third filament responsive to the arrangement for causing at least one filament to travel with the first filament and the second filament being directed to travel coaxially with the second axis of rotation for twisting entanglement of the first filament, the second filament and the third filament as the first filament, the second filament and the third filament are paid out responsive to the arrangement for causing at least one filament to travel resulting in a twisted filament bundle suitable for further processing.

It is preferred that the arrangement for supporting a first filament for payout includes a wound filament package in a filament package support member rotatably mounted to a base for rotation of the wound package during payout of the filament. Further, the base is preferably rotatably driven in the apparatus further includes an assembly for driving the base at a predetermined angular speed. The arrangement for driving the base at a predetermined angular speed is preferably an electric motor operationally connected to the base for driving the base into rotation during payout of the filament. Similarly, the arrangement for supporting a second filament rotatable about an axis of rotation includes a wound filament package and the assembly for rotatably supporting a second filament for payout includes a filament package support member rotatably mounted to a second base for rotation of the wound package during payout of the second filament. Further, the base is preferably rotatably driven and the apparatus further includes an arrangement for driving the second base at a predetermined angular speed, preferably an electric motor operationally connected to the second base for driving the second base into rotation during payout of the filament with the motor having a passageway formed therein coaxially with the axis of rotation for passage therethrough of the first filament for twisting engagement with the second filament.

If is further preferred that the arrangement for supporting a third filament rotatable about a second axis of rotation includes a wound filament package with the arrangement for rotatably supporting a third filament for payment includes a filament package support member rotatably mounted to a third base for rotation of the wound package during payout of the third filament. Preferably, the third base is rotatably driven and the apparatus further includes an assembly for driving the third base at a predetermined angular speed. The assembly for driving the third base at a predetermined angular speed preferably includes an electric motor operationally connected to the third base for driving the third base into rotation during payout of the third filament with the motor having a passageway formed therein coaxially with the second axis of rotation for passage therethrough of the first filament and the second filament for twisting engagement with the first filament.

According to the method of the present invention, a method for continuously treating traveling filaments includes the steps of providing a textile machine for treating the traveling filament; causing at least one filament to travel along a travel path using an arrangement for causing at least one filament to travel along a travel path associated with the textile machine; rotatably supporting a first filament for payout thereof using an assembly for rotatably supporting a first filament for payout thereof responsive to being withdrawn by the assembly for causing a plurality of filaments to travel along the travel path; rotating the assembly for rotatably supporting a first filament using an arrangement for rotating the assembly for rotatably supporting a first filament at a predetermined angular velocity to form a traveling twisted filament during filament payout therefrom with the rotating assembly being associated with textile machines; and applying a treating fluid to the traveling twisted filament using an arrangement for applying a treating fluid to the traveling twisted filament with the arrangement for applying the treating fluid being associated with a textile machine and disposed along the travel path.

The method further preferably includes the step of thermally treating the traveling twisted filament using an assembly for thermally treating a traveling twisted filament with the thermal treatment assembly being disposed along the travel path. It is further preferred that the step of thermally treating the traveling twisted filament includes the step of causing the traveling twisted filament to travel around at least one pair of rolls associated with the textile machine, with at least one of the rolls being driven and heating the traveling twisted filament to a predetermined temperature using an assembly for heating at least one of the rolls to a predetermined temperature for heating a traveling twisted filament trained thereabout.

It is further preferred that the step of applying a treating fluid to the traveling twisted filament includes providing an applicator for metering a predetermined amount of treatment fluid onto the traveling twisted filament. The treating fluid application step preferably includes applying a bonding agent, or release agent, a dye and a lubricant thereto. It will be appreciated by those skilled in the art that any combination of the bonding agent, dye and lubricant may be added as required by the end use of the finished package. The release agent, as will be explained in greater detail hereinafter, is used during processing and does not remain with the finished product.

It is preferred that the step of causing at least one filament to travel along a travel path includes using an assembly for winding the traveling twisted filament on a bobbin associated with the textile machine. It is further preferred that the present invention further include the steps of providing a second filament rotatable about an axis of rotation for payout of the second filament responsive to being withdrawn by the assembly for causing a plurality of filaments to travel, directing the first filament to travel coaxially with the axis of rotation for twisting engagement of the first filament and the second filament as the first filament and second filament are paid out responsive to being withdrawn by the assembly for causing a plurality of filaments to travel resulting in a twisted filament bundle suitable for further filament processing. Additionally, the method of the present invention may include the steps of providing a third filament rotatable about a second axis of rotation for payout of the third filament responsive to being withdrawn by the assembly for causing a plurality of filaments to travel, and directing the second filament to travel coaxially with the second axis of rotation for twisting engagement of the first filament, the second filament and third filament as the first filament, second filament and third filament are paid out responsive to being withdrawn by the assembly for causing at least one filament to travel resulting in a twisted filament bundle suitable for further filament processing.

By the above, the present invention provides a method and apparatus for rapidly and continuously producing twisted, dyed and bonded filaments.

DETAILED DESCRIPTION OF THE PREFERRED EMBODIMENTS

Figure 1:
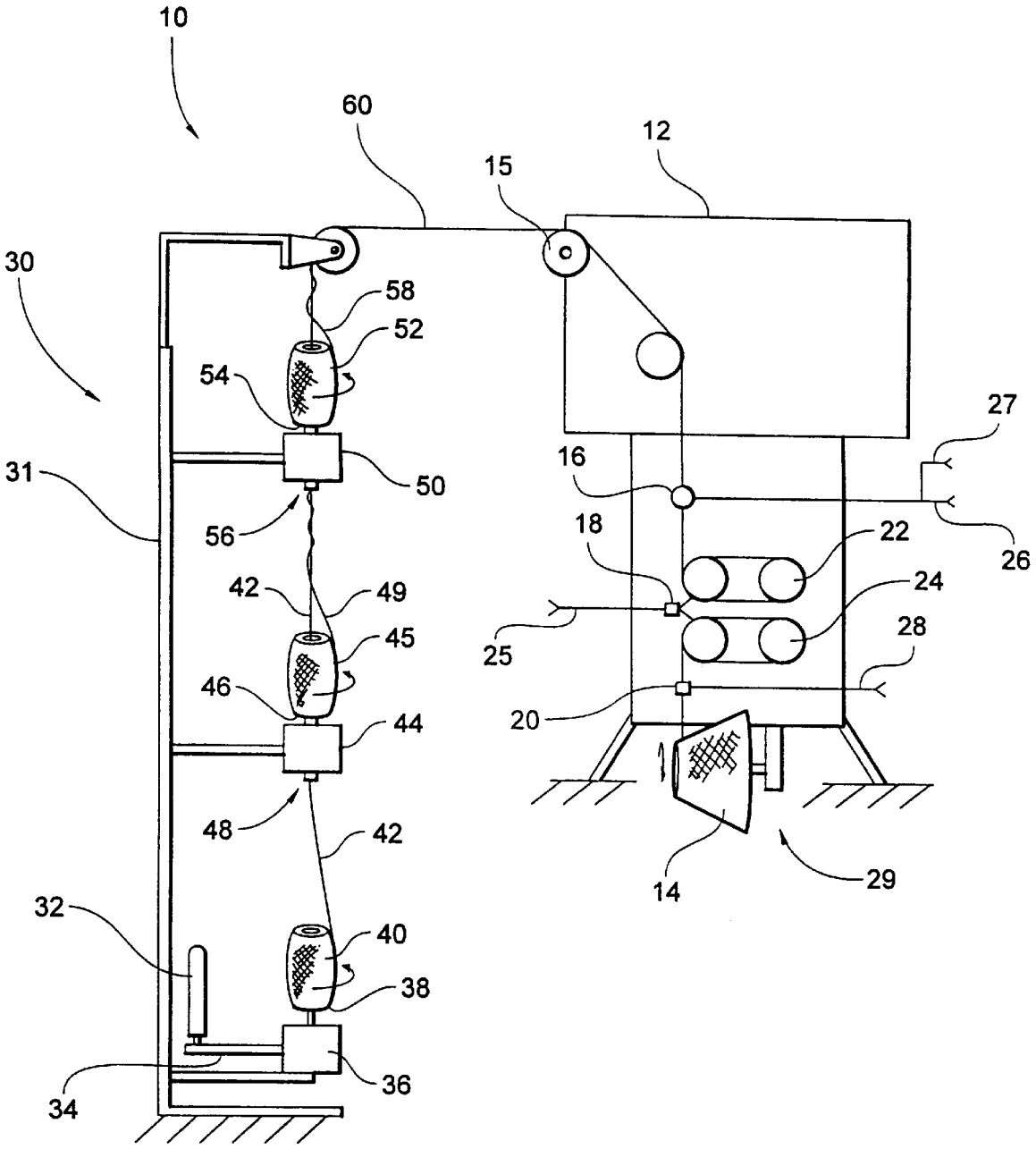
FIG. 1 is a diagrammatic view of an apparatus for producing dyed, twisted and bonded filaments according to one preferred embodiment of the present invention.

Turning now to the drawings and, more particularly, to FIG. 1, an apparatus for producing twisted, dyed and bonded filaments in a continuous in-line process is illustrated generally at 10 in a diagrammatic manner and includes a textile processing machine 12 and a filament supply 30. The textile processing machine 12 may take on virtually any configuration with the restricting requirement being that the elements which will be described in detail presently are arranged in a particular order to define a path for travel of a filament or filament bundle thereacross. Similarly, while the filament supply is shown as a skeletal frame structure, it will be appreciated that many configurations are possible by those skilled in the art with the primary requirements being consistent with those described below.

Figure 2:
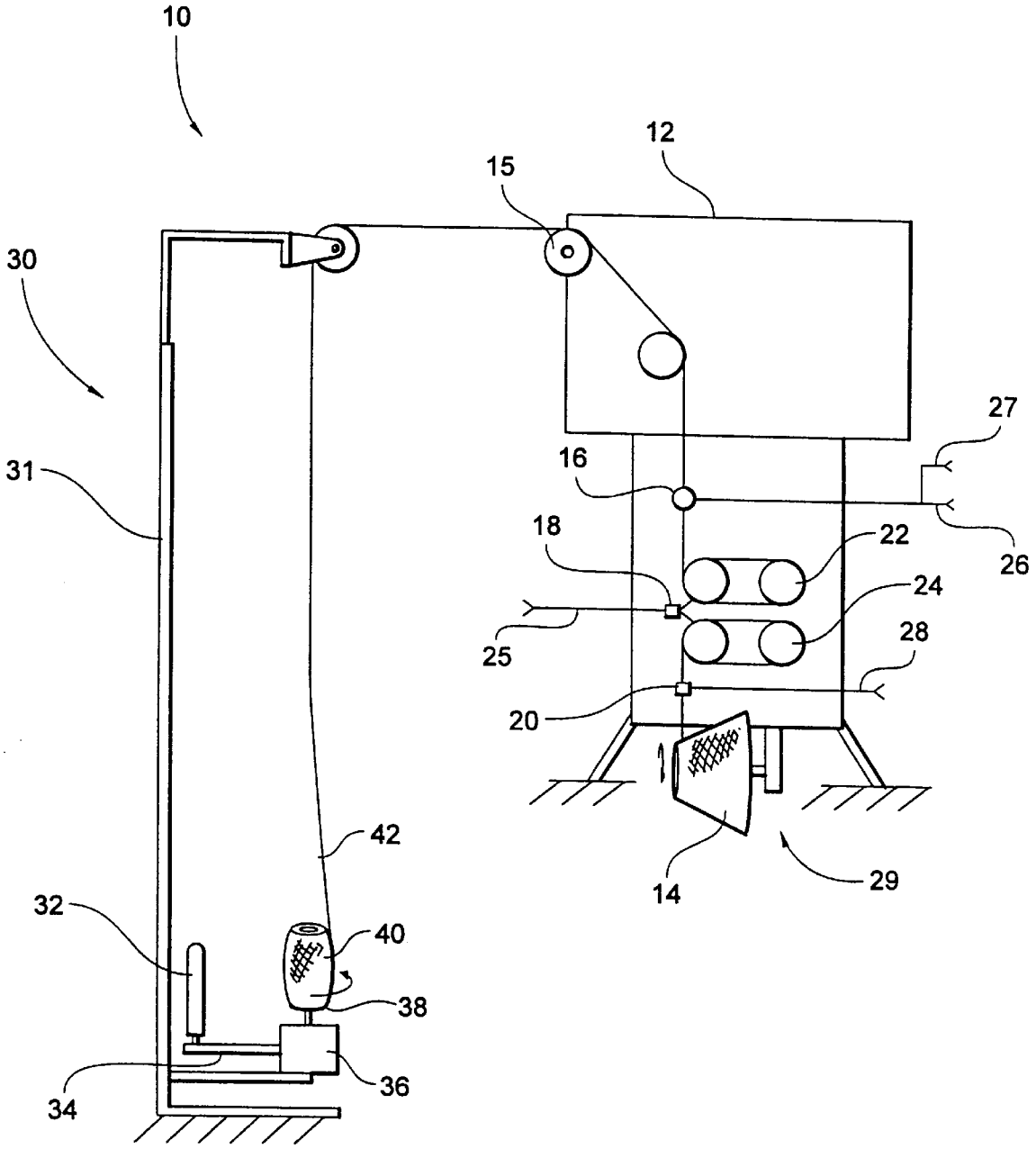
FIG. 2 is a diagrammatic view of an apparatus for producing dyed, twisted and bonded filaments according to a second preferred embodiment of the present invention.
Figure 3:
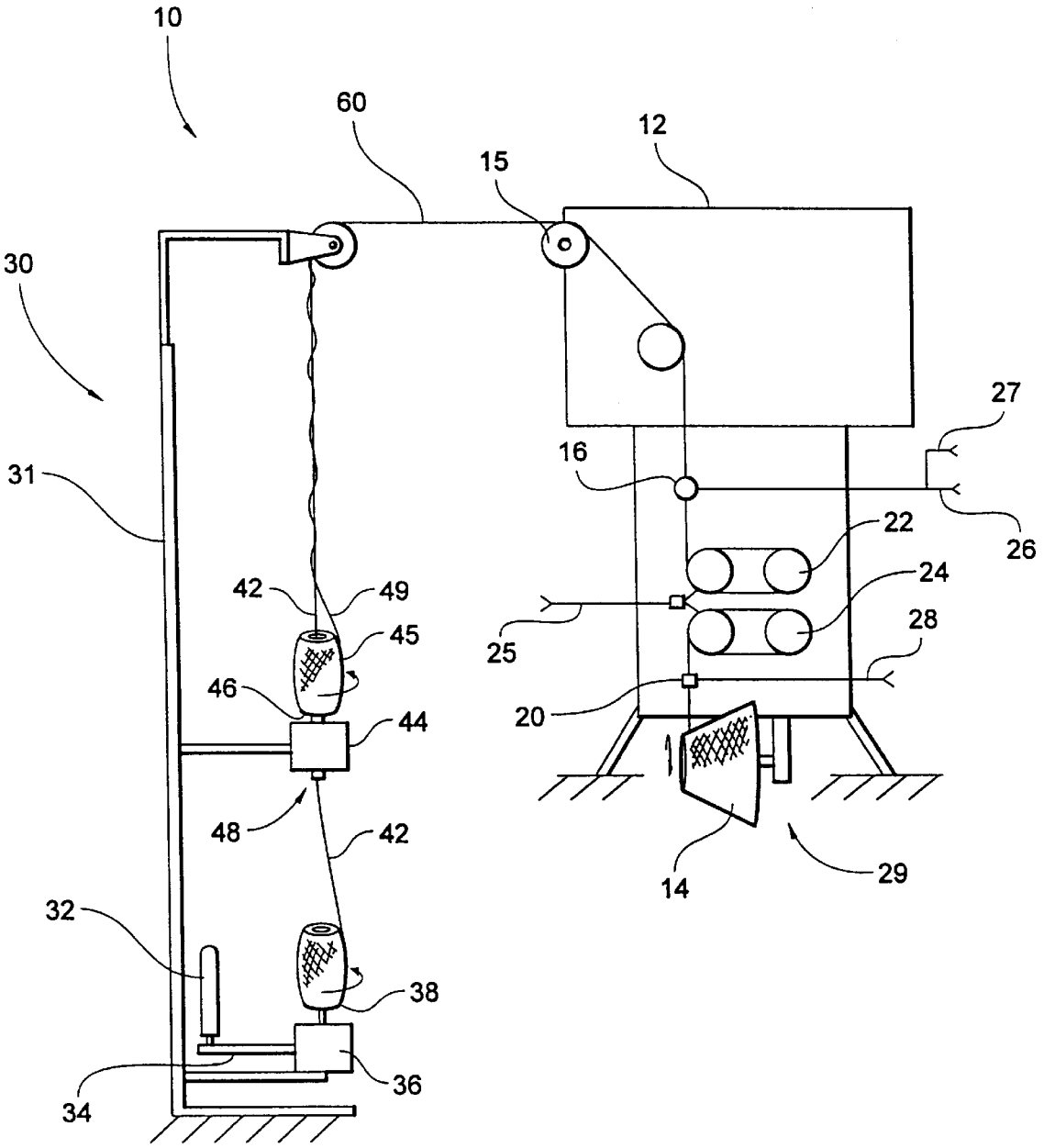
FIG. 3 is a diagrammatic view of an apparatus for producing dyed, twisted and bonded filaments according to a third preferred embodiment of the present invention.

Turning now to the filament supply 30, a skeletal frame 31 is illustrated in FIG. 1 for supporting any number of filament packages. As seen in FIG. 1, three filament packages are provided for forming a twisted bundle of three filaments. FIG. 2 illustrates a single filament which may be twisted in the manner to be described presently. FIG. 3 is another version illustrating a pair of yarn packages for providing a twisted pair of filaments for processing. As may be appreciated, the choice of one, two, three or more filament packages is based on the requirements of the end user and it will not deviate from the present invention to use virtually any number of filaments in a manner described herein.

Focusing now on FIG. 1, a first filament package 40 is illustrated mounted to a rotatable platform 38 which is in turn mounted to a base 36 in vertical arrangement. The base 36 is mounted to the frame 31. An electric motor 32 is provided and mounted to the frame 31 and joined to the rotatable base using a belt 34. It will be appreciated by those skilled in the art that such a belt drive system is possible for driving the base 38 into rotation. It is also possible to use a direct drive motor to drive the base. A second, direct drive motor 44 is mounted vertically above the first filament package 40 and includes a rotatable base 46 attached to the armature thereof. A second filament package 45 is attached to the rotatable base 46. The armature of the direct drive motor 44 is hollow providing a passageway 48 for passage of the first filament 42 therethrough. Similarly, the second filament package 45 is mounted on a hollow tube which is in registry with the aforesaid passageway 48 for passage of the first filament 42 from the first filament package to a position above the second filament package 45. A second filament 49 is withdrawn from the second filament package and trained around the first filament emerging from the passageway 48. A third filament package 52 is mounted to a rotatable base 54 which is in turn mounted to another direct drive motor 50 similar to the first direct drive motor 44. Once again, a passageway 56 is formed in the armature of the second direct drive motor 50 for passage of the first filament 42 and the second filament 49 which are, by then, interlaced. This pair emerges from a hollow tube on which the third filament package 52 is mounted. The first and second filaments 42,49 emerge from the second passageway 56 to be interlaced with the third filament 58 being withdrawn from the third filament package 52. The resulting tri-filament bundle 60 is directed from the frame 31 to a yarn guide 15 disposed on the textile machine 12.

The textile machine 12 includes a first metering applicator 16 which meters a predetermined amount of bonding agent through a bonding agent supply line 27 from a bonding agent supply (not shown). Similarly, a release agent supply line 26 supplies a release agent selectively from a release agent supply (not shown) for mixing with the bonding agent for application to the filament bundle 60 in the first metering applicator 16. Downstream from the first metering applicator, a first pair of heated rolls 22 is provided. One or both of the rolls 22 may be heated to a temperature of approximately 100° C. to 230° C. A second metering applicator 18 is mounted to the textile machine downstream from the first heated roll pair 22 and is fed dye through a supply line 25 from a dye supply (not shown). A second heated roll pair 24 is provided downstream from the second applicator 18. The second heated roll pair is heated to a temperature of approximately 220° C. to 250° C. A third applicator 20 is provided downstream from the second heated roll pair 24 and mounted to the textile machine 12. The third applicator 20 is primarily for the application of lubricant through a lubricant supply line 28 from a lubricant supply (not shown).

All metering applicators 16,18,20 are configured to apply a predetermined amount of their respective liquid agents per unit running length of filament material. The amount of a specific agent chosen is dependent on the amount which the material will effectively carry and retain upon heat application. Insufficient amounts of liquid agents can result in a poorly finished product while excess amounts of liquid agents may be splattered upon application of heat or may run, both of which can be detrimental to the finished product. A proper amount will be whatever amount, determined primarily by experimentation, necessary to fully saturate the predetermined running length of material, or that which produces the desired effect on the filament material.

Finally, a conventional winder 29 is mounted to the textile machine to wind the filament bundle 60 onto a package 14 for later use. As may be appreciated, the winder 29 provides an arrangement for causing the filament bundle 60 to travel along the predefined travel path defined by the components previously described. Further driving influence is provided to the yarn bundle 60 by the driven, heated rolls 22,24. Therefore, the apparatus of the present invention provides a continuous, in-line processing assembly for individual filaments or filament bundles.

In operation, when it is determined what type of processing and how many filaments are to be processed, the necessary filament supply packages 40,45,52 are mounted to their respective rotatable bases 38,46,54 and thread-up commences. The first filament 42 is unwound from the first package 40 and fed into the passageway 48 associated with the second filament package. It is withdrawn therefrom and a second filament 49 is withdrawn from the second filament package 45 and interlaced with the first filament 42 to form a pair of interlaced filaments which are fed into the second passageway 56 associated with the third filament package 52. It is withdrawn therefrom and a third filament 58 is withdrawn from the third filament package 52 and interlaced with the aforesaid pair to form a tri-filament bundle 60 which is wound from the frame across the necessary yarn guides and onto the textile machine 12.

Thread-up continues with the filament bundle 60 extending through the first applicator 16 and from there it is trained around the first roll pair 22 which, as may be appreciated, is not yet heated. After being trained several times around the first roll pair 22, the filament bundle 60 is directed through the dye applicator 18 and then is trained several times around the second heated roll pair 24 which, of course, is not yet heated. From the second heated roll pair 24, the filament bundle is directed to the lubricant applicator 20 and from there wound onto a bobbin for winding by the winder 29 to form the finished package 14 once operations continue.

With reference to FIG. 2, a single filament may be threaded from its package 40 through the yarn guides and onto the textile machine 12. Referring to FIG. 3, a twisted pair is formed by omitting the third filament bundle while directing the first filament 42 through the second filament passageway 48 for interlacing with a second filament 49 being withdrawn from the second filament package 45. Operations of the various number of filaments is substantially identical except for the presence or absence of the additional filaments.

Once thread-up has been completed, the operations may then commence. With the winder 29 pulling yarn through the travel path, the respective motors 32,44,50 for the filament packages 40,45,52 are energized and are driven at a predetermined angular velocity which is typically on the order of 15,000 rpm to 20,000 rpm. By way of example, a 15,000 rpm rotation provides approximately three twists per inch in a traveling filament bundle. Preferably, all three filament packages 40,45,52 are driven in the same angular direction. Since the winder 29 is propelling the filaments along the travel path, pumps (not shown) are provided to supply the bonding agent and release agent mixture to the bonding agent applicator 16. The bonding agent is typically a nylon resin but may be other bonding agents as required by the type of filament involved in the process. The release agent may be a silicon oil and is provided to prevent the filaments from sticking to the heated rolls. The first heated roll pair 22 is heated to a predetermined temperature of approximately 150° C. which removes the aqueous carrier from the bonding agent, leaving the bonding agent coating the filament. Notably, if the bonding agent is polyester, a release agent may not be needed because it has been determined that using polyester as a bonding agent allows the filament to be heated by the roll pair to approximately 150° C. without the need for a release agent. The aqueous carrier for the polyester bonding agent flashes to steam forming a steam layer intermediate the heated rolls 22 and the filament bundle 60 which prevents the aforesaid sticking.

From the first heated roll pair 22, a liquid, aqueous dye may be applied in the dye applicator 18. After the dye is applied the filament bundle 60 travels around the second heated roll pair 24 for heating to a much higher temperature to set the dye and bonding agent. The temperature of the second heated roll pair 24 is on the order of 220° C. to 250° C. From the second heated roll pair 24, the filament bundle 20 proceeds through the lubricant applicator 20 where a lubricant, preferably silicone, is applied to the filament bundle which is then wound onto a package in a finished form.

By the above, the present invention provides a method and apparatus for continuously producing a twisted, dyed, bonded filament which proceeds from the raw filament packages to a finished product which can produce the finished product at a rate of approximately 1,000 meters per minute. The use of the present invention greatly reduces the cost of producing twisted, dyed and bonded filaments and provides the flexibility necessary to add or eliminate treatment liquids as required by the end use of the finished product.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An apparatus for continuously making and treating a traveling twisted filament bundle, comprising:

means for causing a twisted filament bundle to travel along a travel path;

first means for rotatably supporting a first filament package about a first axis of rotation for payout of a first filament responsive to said travel means;

second means for rotatably supporting a second filament package about a second axis of rotation for payout of a second filament responsive to said travel means;

means for rotating said first support means about the first axis of rotation during filament payout of the first filament therefrom;

means for rotating said second support means about the second axis of rotation during filament payout of the second filament therefrom;

means for directing the first filament to travel in response to said travel means through the second filament package coaxially with the second axis of rotation for entanglement of the second filament about the first filament during payout of both filament packages to thereby form a traveling twisted filament bundle; and means for applying a treating fluid to the traveling twisted filament bundle, said application means being disposed along the travel path.

2. An apparatus according to claim 1 further comprising means for thermally treating the traveling twisted filament bundle, said thermal treatment means being disposed along the travel path.

3. An apparatus according to claim 2 wherein said means for thermally treating the traveling twisted filament bundle includes at least one pair of rolls, at least one of said rolls being driven, and means for heating at least one of said rolls to a predetermined temperature for heating a traveling twisted filament bundle trained thereabout.

4. An apparatus according to claim 1 wherein said means for applying a treating fluid to the traveling twisted filament bundle includes an applicator for metering a predetermined amount of treatment fluid onto the traveling twisted filament bundle.

5. An apparatus according to claim 4 wherein said means for applying a treating fluid to the traveling twisted filament bundle includes a supply of treatment fluid including a bonding agent and a release agent.

6. An apparatus according to claim 4 wherein said means for applying a treating fluid to the traveling twisted filament bundle includes a supply of treatment fluid including a dye.

7. An apparatus according to claim 4 wherein said means for applying a treating fluid to the traveling twisted filament bundle includes a supply of treatment fluid including a lubricant.

8. An apparatus according to claim 1 wherein said means for causing the twisted filament bundle to travel along the travel path includes means for winding the traveling twisted filament bundle on a bobbin.

9. An apparatus according to claim 1 further comprising third means for rotatably supporting a third filament package rotatable about a third axis of rotation for payout of a third filament responsive to said travel means;

means for rotating said third support means about the third axis of rotation during filament payout of the third filament therefrom; and means for directing the first filament and the second filament forming the traveling twisted filament bundle to travel through the third filament package coaxially with the third axis of rotation for entanglement of the third filament about the first filament and the second filament during payout of the filament packages.

10. An apparatus according to claim 1 wherein said first support means includes a first filament package support member rotatably mounted to a base for rotation of the first filament package during payout of the first filament.

11. An apparatus according to claim 10 wherein said first filament package support member is rotatably driven at a predetermined angular speed.

12. An apparatus according to claim 11 wherein said means for rotating said first support means includes an electric motor operationally connected to said first filament package support member for driving said first filament package support member into rotation during payout of the first filament.

13. An apparatus according to claim 12 wherein said second support means includes a second filament package support member rotatably mounted to a second base for rotation of the second filament package during payout of the second filament.

14. An apparatus according to claim 13 wherein said second filament package support member is rotatably driven at a predetermined angular speed.

15. An apparatus according to claim 14 wherein said means for rotating said second support means includes an electric motor operationally connected to said second filament package support member for driving said second filament package support member into rotation during payout of the second filament, and said means for directing the first filament includes passageway formed in said motor coaxially with said second axis of rotation for a passage therethrough of the first filament for twisting engagement with the second filament.

16. An apparatus according to claim 9 wherein said third support means includes a third filament package support member rotatably mounted to a third base for rotation of the third filament package during payout of the third filament.

17. An apparatus according to claim 16 wherein said third filament package support member is rotatably driven at a predetermined angular speed.

18. An apparatus according to claim 17 wherein said means for rotating said third support means includes an electric motor operationally connected to said third filament package support member for driving said third filament package support member into rotation during payout of the third filament, and said means for directing the first filament and the second filament includes a passageway formed in said motor coaxially with said third axis of rotation for passage therethrough of the first filament and the second filament for twisting engagement with the third filament.

19. A textile processing machine for forming a twisted filament bundle, comprising:

a first platform for supporting a first filament package and rotatable about a first axis of rotation;

a second platform for supporting a second filament package and rotatable about a second axis of rotation, said second platform further defining a traveling filament passageway therethrough along said second axis of rotation;

means for rotating said second platform; and means for withdrawing a first filament from a filament package supported by said first platform through said traveling filament passageway of said second platform, and for withdrawing a second filament from a filament package supported by said second platform for entanglement of the second filament about the first filament after emerging from said traveling filament passageway to thereby form a twisted filament bundle.

20. A textile processing machine according to claim 19, further comprising means for rotating said first platform.

21. A textile processing machine according to claim 19, wherein said first axis of rotation and said second axis of rotation are collinear.

22. A textile processing machine according to claim 21, wherein said second platform is disposed above said first platform.

23. A textile processing machine according to claim 19, further comprising:

a third platform for supporting a third filament package and rotatable about a third axis of rotation, said third platform defining a second traveling filament passageway therethrough along said third axis of rotation; and means for rotating said third platform;

wherein said withdrawing means withdraws said first and second filaments through said second traveling filament passageway and withdraws a third filament from a filament package supported by said third platform for entanglement of the third filament about the first and second filaments after emerging from said second traveling filament passageway.

24. A textile processing machine according to claim 23, wherein said first axis of rotation, said second axis of rotation, and said third axis of rotation are collinear.

25. A textile processing machine according to claim 24, wherein said third platform is disposed above said second platform and said second platform is disposed above said first platform.

* * * * *